US006086375A

United States Patent [19]

Legros

[11] Patent Number: 6,086,375

[45] Date of Patent: Jul. 11, 2000

[54] FIREARM TRIGGER PULL MEASURING DEVICE

[76] Inventor: Victor E. Legros, 3855 S. Atlantic Ave., No. 602, Datona Beach Shores, Fla. 32127

[21] Appl. No.: 09/385,428

[22] Filed: Aug. 30, 1999

[51] Int. Cl.[7] ..... F41G 3/26

[52] U.S. Cl. ..... 434/16; 73/862.42; 434/11

[58] Field of Search ..... 434/11, 16; 42/97, 42/DIG. 1; 73/862.42, 862.471, 862.392, 379.03, 379.08

[56] References Cited

U.S. PATENT DOCUMENTS

| | | | |
|---|---|---|---|
| 1,822,352 | 9/1931 | Laursen | 73/862.42 |
| 2,590,498 | 3/1952 | Bomberger | 73/862.42 |
| 3,432,930 | 3/1969 | Ljunberg | 73/862.42 |
| 3,559,470 | 2/1971 | McDowell | 73/862.42 |
| 4,913,655 | 4/1990 | Pinkley et al. . | |

FOREIGN PATENT DOCUMENTS

| | | |
|---|---|---|
| 2583163 | 12/1986 | France . |
| 75594 | of 0000 | Germany . |
| 70170 | 8/1893 | Germany . |
| 223978 | 1/1943 | Switzerland . |

*Primary Examiner*—Sam Rimell
*Attorney, Agent, or Firm*—Stephen R. Greiner

[57] ABSTRACT

A device for measuring the force required to discharge a firearm by pulling its trigger. The device includes a base with a threaded rod rotatably secured thereto. A spring balance is threadably fastened to the threaded rod and is adapted for movement relative to the base when the threaded rod is rotated. The spring balance has a piston rod with a free end formed into a catch for engaging the trigger of a firearm on the base. An upwardly-extending, trigger guard retainer is affixed to the base adjacent the free end of the piston rod for retaining the firearm. By rotating the threaded rod, the piston rod is drawn against the firearm trigger such that the force required to discharge the firearm can be read from the spring balance.

3 Claims, 2 Drawing Sheets

FIREARM TRIGGER PULL MEASURING DEVICE

FIELD OF THE INVENTION

The present invention relates generally to firearm indicators.

BACKGROUND OF THE INVENTION

Various means for measuring the force required to discharge a firearm by pulling its trigger have been proposed in the past. Scales, gauges, and hanging weights comprise today's state of the art. Unfortunately, such products are cumbersome to use and provide less than accurate measurements.

SUMMARY OF THE INVENTION

In light of the problems associated with the prior art, it is a principal object of the invention to provide a firearm trigger pull measuring device which can, with great accuracy, measure the force required to discharge a firearm.

It is another object of the invention to provide a firearm trigger pull measuring device of the type described which may be used with firearms of various types and dimensions without resort to special tools or extensive training. Thus, the inventive measuring device may be used to readily test: pistols, revolvers, rifles, shotguns and other trigger-actuated weapons.

It is an object of the invention to provide improved elements and arrangements thereof in a measuring device for the purposes described which is lightweight in construction, inexpensive to manufacture, and dependable in use.

Briefly, the measuring device in accordance with this invention achieves the intended objects by featuring a base with a threaded rod rotatably secured thereto. A spring balance is threadably fastened to the threaded rod. The spring balance has a piston rod with a free end formed into a catch for engaging the trigger of a firearm positioned on the base. A trigger guard retainer extends upwardly from the base adjacent the free end of the piston rod for retaining the firearm on the base.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
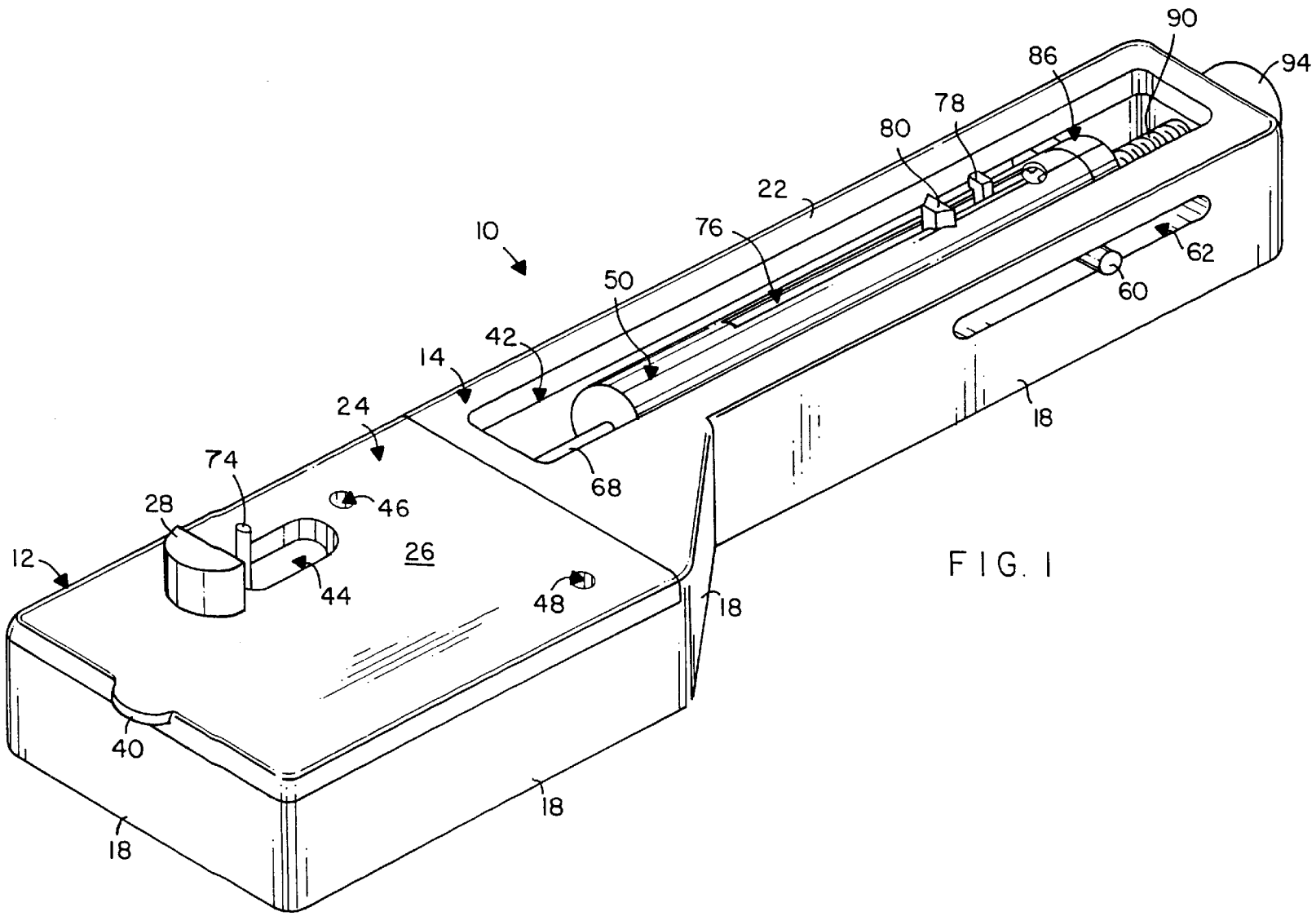
FIG. 1 is a perspective view of a firearm trigger pull measuring device in accordance with the present invention.

Referring now to the FIGS., a firearm trigger pull measuring device in accordance with the present invention is shown at 10. Device 10 includes a base 12 having a platform 14 held at a fixed height above a horizontal supporting surface 16 by a wall 18 extending downwardly from the periphery of platform 14 and a cross brace 20 connecting opposite sides of wall 18 together. Preferably, platform 14 has a front portion 22 that is integrally formed with wall 18 and a rear portion 24 that is separately made and detachable.

Rear portion 24 of platform 14 has a rectangular plate 26 with a number of projecting features. For example, a trigger guard retainer 28, having a D-shaped cross section, extends upwardly from plate 26. Flanges 30 and 32, however, extend downwardly from the side and rear edges of plate 26. From the front edge of plate 26, a finger 34 reaches downwardly and forwardly to engage the bottom of front portion 22. A bead 36 projects rearwardly from flange 32 for positioning within a mated groove 38 in wall 18. So that bead 36 may be easily separated from groove 38, a tab 40 is provided which protrudes laterally from the rear edge of plate 26.

Platform 14 includes a number of voids. Front portion 22 of platform 14 includes a slot 42 aligned with trigger guard retainer 28 of rear portion 24. Rear portion 24, however, has a passage 44 in plate 26 aligned with both retainer 28 and slot 42. Between slot 42 and passage 44 are a pair of offset bores 46 and 48.

Within slot 42 is positioned a portion of a spring balance 50. As shown, spring balance 50 includes a body 52 comprising a tubular side wall 54 whose ends are capped by a rear end wall 56 and a front end wall 58. Adjacent end wall 58, pins 60 project outwardly from side wall 54 and through channels 62 provided in opposite sides of peripheral wall 18 of base 12.

Positioned within body 52 and against end wall 56 is a coiled spring 64. Abutting spring 64 adjacent end wall 58 is a piston 66 adapted to compress spring 64. A piston rod 68 extends rearwardly through spring 64 so as to project from an opening 70 in end wall 56. Outside body 52, rod 68 passes through a small opening 72 in cross brace 20 and terminates at a free end 74 which is bent upwardly to form a catch projecting from passage 44 in plate 26.

An elongated passageway 76 is provided in the top of side wall 54 from which a tab 78 on piston 66 projects. The tab 78 is adapted to engage a slide 80 which is configured to freely run the length of passageway 76 and point to a scale 82 having a series of marks located along passageway 76 at regular intervals for measuring a force imparted on spring 64.

End wall 58 of spring balance 50 is secured by means of a threaded fastener 84 to a retaining block 86. Retaining block 86 juts beneath scale 50 and is provided with a threaded aperture 88 oriented parallel to the longitudinal axis of body 52 for receiving a threaded rod 90 having an end 92 journaled for rotation in the front end of peripheral wall 18. Outside base 12, a knob 94 is fastened to rod 90 for manually rotating such.

Figure 2:
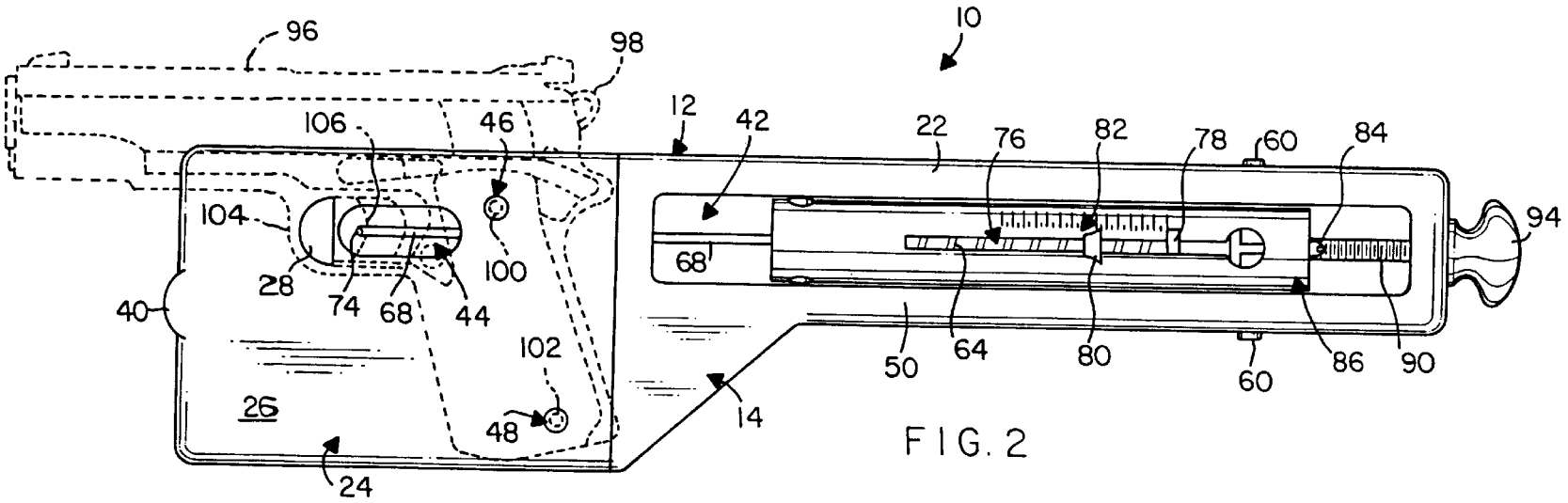
FIG. 2 is a top view of the device of FIG. 1 with a firearm positioned thereon illustrated in broken lines.
Figure 3:
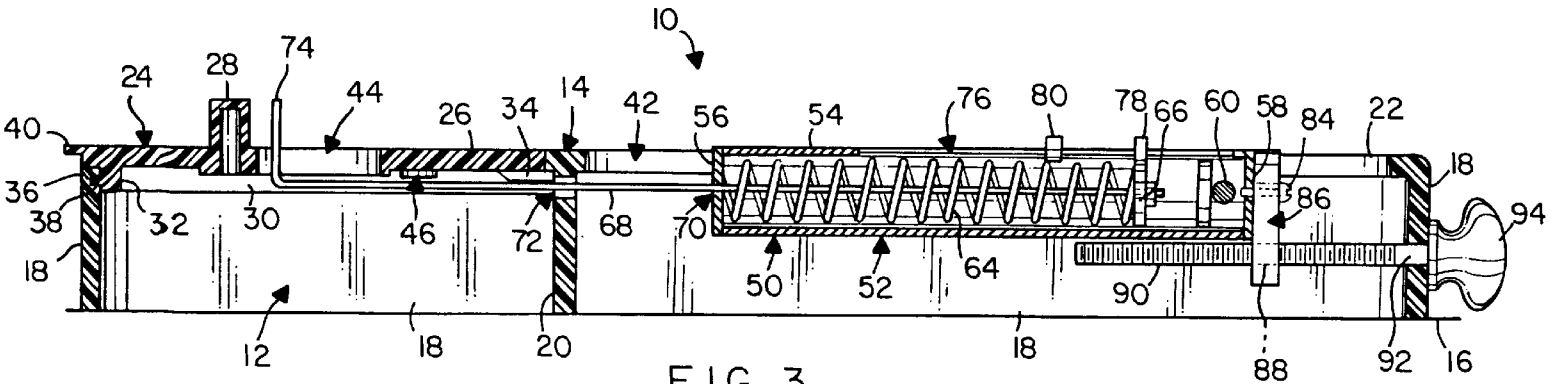
FIG. 3 is a longitudinal cross-sectional view of the device.

Use of device 10 is straightforward. First, an unloaded firearm 96 (with its hammer 98 cocked and its stock removed to expose stock screw bushings 100 and 102) is positioned above plate 26. Then, as shown in FIG. 2, the trigger guard 104 of firearm 96 is positioned around retainer 28 and the upturned end 74 of rod 68 is lightly engaged with firearm trigger 106. Simultaneously, stock screw bushings 100 and 102 on the right side of firearm 96 are snugly positioned in offset bores 46 and 48 to firmly secure firearm 96 to device 10. Now, knob 94 is rotated to draw spring balance 50 and rod 68 toward the front end of base 12 and against trigger 106.

Continued rotation of knob 94 applies increased pressure on trigger 106 and compresses spring 64. Compression of spring 64 may be visually gauged by movement of tab 78 relative to scale 82. By action of tab 78 against slide 80 a record of the point where trigger 106 released the internal firing mechanism of firearm 96 causing motion of hammer 98 can be obtained. Whether a manufacturer's recommended trigger pull settings are being followed can be immediately ascertained by a user.

Of course, the procedure set forth above may be repeated as often as necessary. It will not harm firearm 96 in any way. When firearm 96 is sufficiently tested, such is lifted from platform 14 whereby the stock of firearm 96 can be reattached so as to cover stock screw bushings 100 and 102. Firearm 96 is ready for immediate reuse.

While the invention has been described with a high degree of particularity, it will be appreciated by those skilled in the art that modifications may be made thereto. For example, the number and location of offset bores 46 and 48 on plate 26 may be varied to accommodate firearms of different dimensions. Therefore, it is to be understood that the present invention is not limited to the sole embodiment described above, but encompasses any and all embodiments within the scope of the following claims.

I claim:

1. A firearm trigger pull measuring device, comprising:

a base having a first end and a second end remote from said first end;

a threaded rod rotatably secured to said first end of said base and extending toward said second end of said base;

a spring balance threadably fastened to said threaded rod and adapted for movement relative to said base when said threaded rod is rotated, said spring balance having a piston rod extending therefrom toward said second end of said base, said piston rod having a free end being formed into a catch for engaging the trigger of a firearm; and, a trigger guard retainer affixed to said base and extending upwardly from said second end thereof adjacent said free end of said piston rod for engaging the trigger guard of a firearm and retaining said firearm upon said base.

2. A firearm trigger pull measuring device, comprising:

a base having: a first end, a second end remote from said first end, and a pair of offset bores between said first and second ends adapted to snugly receive the stock screw bushings of a firearm;

a threaded rod rotatably secured to said first end of said base and extending toward said second end of said base;

a spring balance threadably fastened to said threaded rod and adapted for movement relative to said base when said threaded rod is rotated, said spring balance having a piston rod extending therefrom toward said second end of said base, said piston rod having a free end being formed into a catch for engaging the trigger of a firearm; and, a trigger guard retainer affixed to said base and extending upwardly from said second end thereof adjacent said free end of said piston rod for engaging the trigger guard of a firearm and retaining said firearm upon said base.

3. A firearm trigger pull measuring device, comprising:

a base having a platform with a downwardly extending peripheral wall, said platform having opposed, first and second ends and a slot extending between said first and second ends;

a threaded rod rotatably secured to said peripheral wall adjacent said first end of said platform and extending toward said second end of said platform;

a spring balance positioned within said slot and threadably fastened to said threaded rod, said spring balance being adapted for movement relative to said base when said threaded rod is rotated, said spring balance having a piston rod extending therefrom toward said second end of said platform, said piston rod having a free end being formed into a catch for engaging the trigger of a firearm; and, a trigger guard retainer affixed to said platform and extending upwardly from said second end thereof adjacent said free end of said piston rod for engaging the trigger guard of a firearm and retaining said firearm upon said platform.

* * * * *